US005536082A

United States Patent [19]

Ritchie et al.

[11] Patent Number: 5,536,082

[45] Date of Patent: Jul. 16, 1996

[54] GAME PLAYFIELD MOUNTING SYSTEM

[75] Inventors: Steve Ritchie; Peter Piotrowski; Carl Biagi, all of Chicago, Ill.

[73] Assignee: Williams Electronics Games, Inc., Chicago, Ill.

[21] Appl. No.: 503,651

[22] Filed: Jul. 18, 1995

[51] Int. Cl.[6] ..... A47B 88/00

[52] U.S. Cl. ..... 312/322; 273/118 R

[58] Field of Search ..... 273/108, 118 R, 273/118 A, 119; 312/265.6, 293.1, 293.2, 293.3, 327, 284, 325, 290, 237, 322

[56] References Cited

U.S. PATENT DOCUMENTS

| | | | |
|---|---|---|---|
| 1,625,011 | 4/1927 | Wolfe et al. | 312/322 |
| 2,037,413 | 4/1936 | Gloekler | 312/322 |
| 5,193,807 | 3/1993 | Schilling et al. | 312/325 |
| 5,494,285 | 2/1996 | Coldebella et al. | 273/119 |

FOREIGN PATENT DOCUMENTS

| | | | |
|---|---|---|---|
| 0491271 | 3/1953 | Canada | 273/118 |

*Primary Examiner*—Peter M. Cuomo
*Assistant Examiner*—Gerald A. Anderson
*Attorney, Agent, or Firm*—Rockey, Rifkin and Ryther

[57] ABSTRACT

The disclosed device relates to an improved system for mounting a game playfield within a game cabinet. The device provides pivotal and sliding movement of the playfield with respect to the cabinet while allowing quick removal of the playfield entirely from the game cabinet. The game cabinet is provided with a groove on each side thereof and spring-biased pivot pins are mounted on the playfield for travel within a respective groove in the cabinet.

18 Claims, 6 Drawing Sheets

GAME PLAYFIELD MOUNTING SYSTEM

BACKGROUND OF THE INVENTION

The invention relates generally to game cabinets and more particularly, to an improved system for mounting a game playfield within a game cabinet.

Pinball game cabinets house an inclined playfield that supports a rolling ball and a plurality of play features such as targets, bumpers, ramps and the like. Player controlled flippers are also mounted on the playfield to control the movement of the ball. The game cabinet is provided with a plate of glass on top so that the player can view the playfield during play. The game cabinet also houses the mechanical and electrical components that control the play features and operation of the game. Many of these components are secured directly to the top and/or underside of the playfield.

Pinball machines require periodic maintenance because the mechanical and electrical components are subject to frequent and extended use. Therefore, access to the electrical and mechanical components is necessary to maintain and repair the components. Access is gained by removing the playfield glass and pivoting the playfield relative to the cabinet to an upright position in which the components on the underside of the playfield can be accessed. The features on the top of the playfield usually occupy a large mount of space and therefore, movement of the playfield is restricted. Moreover, the weight of the components which are secured to the playfield usually make pivotal movement of the playfield difficult by the person repairing the pinball machine.

Prior an attempts to remedy the above problems have resulted in complex mechanisms for providing the pivotal movement of playfield. For example, U.S. Pat. No. 5,193,807 to Schilling, et al. teaches a sliding mount for a pinball playfield which increases the access to the underside of the playfield by allowing the playfield to pivot through an angle of more than 90 degrees relative to the cabinet. Schilling, et al., however, requires a relatively complex sliding mechanism which has numerous parts. Moreover, the pivotal movements undergone by the playfield in the invention of Schilling, et al. requires that the operator or repair person shift the entire weight of the playfield as it is slid forward before being pivoted to the upright position.

Thus, a device providing pivotal movement of the playfield is desired which facilitates easy access to the interior of the cabinet and which employs a simple mechanism for providing the pivotal movement of the playfield while reducing the amount of physical effort required to access the game components.

SUMMARY OF THE INVENTION

The present invention provides pivotal and sliding movement of the playfield with respect to the cabinet while allowing quick removal of the playfield entirely from the game cabinet. The game cabinet is provided with a groove on each side thereof and spring-biased pivot pins are mounted on the playfield for travel within a respective groove. The simple construction of the present invention reduces the number of parts required to provide complete access to the playfield with a corresponding reduction in the cost of manufacture.

DETAILED DESCRIPTION OF THE INVENTION

Figure 1:
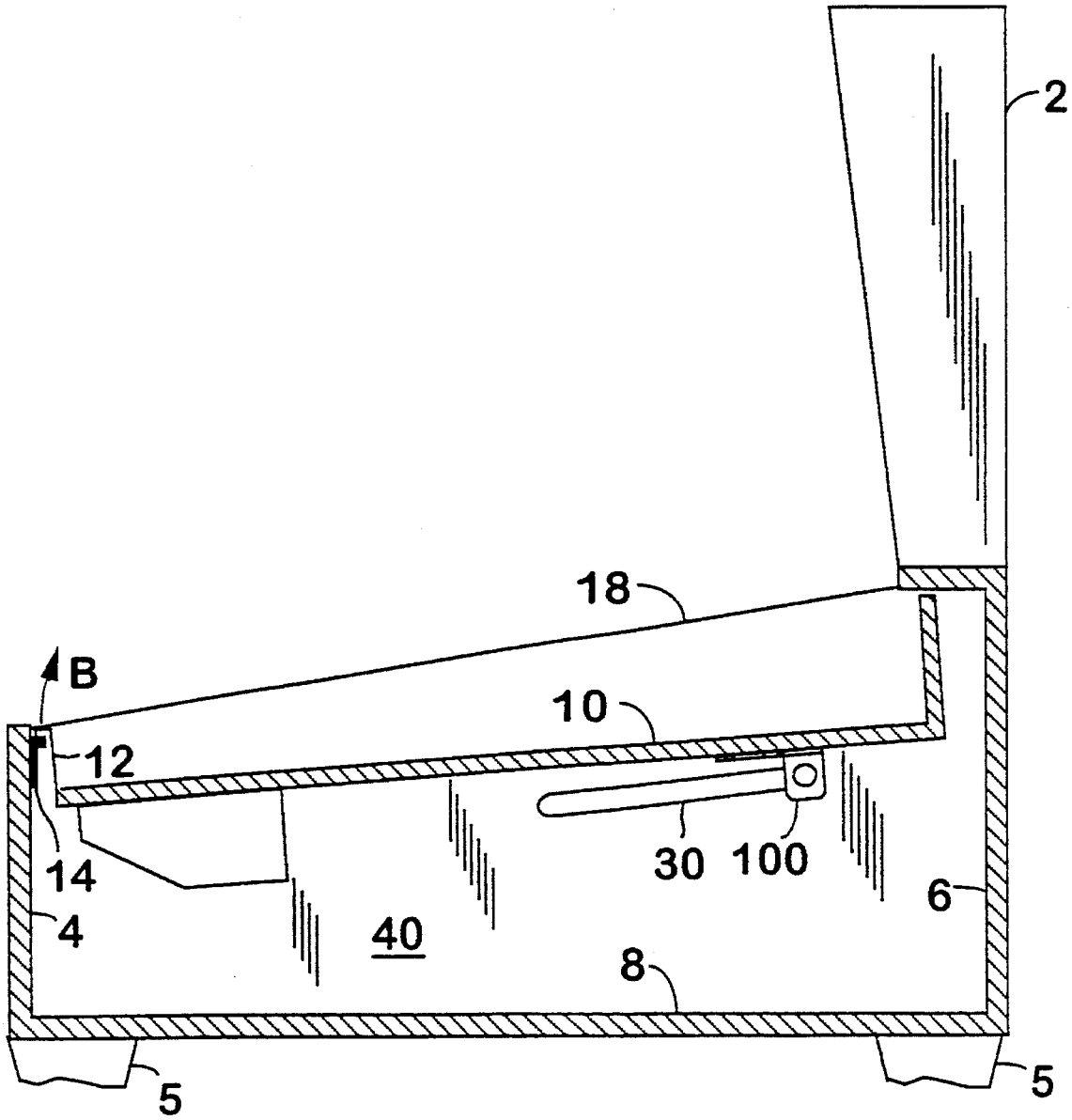
FIG. 1 is a side-sectional view of the cabinet of a preferred embodiment of the present invention illustrating a pivot pin and groove.

Referring particularly to FIG. 1, an embodiment of the invention comprises a game cabinet which includes a front panel 4, side walls 40 (only one of which is shown in the Figure), a bottom panel 8, and a rear panel 6 forming a box-like construction. FIG. 1 depicts a cross-section of the game cabinet and playfield with the groove in the left side of the game cabinet illustrated. It is to be understood that a second groove and pivot pin are provided on the right side panel of the game cabinet but are not shown. The game cabinet is supported on legs 5 which elevate the cabinet above the floor. A back box 2 houses display and scoring devices for viewing by the player. A glass plate is provided (not shown) on the upper side of the game cabinet to permit viewing of the playfield.

The playfield is generally denoted 10. The various play features which are provided on the top of the playfield and the mechanical and electrical components that are attached to the underside to the playfield have been omitted from the drawings for clarity.

A pivot pin assembly 100 is attached to the left portion of the underside of the playfield and supported within groove 30 to provide support to the rear portion of the playfield. The front side of the playfield is supported via bracket 12, which is attached to the playfield, and bracket 14 which is attached to the cabinet. Guide elements or bumpers 16, only one of which is shown in FIG. 1, are fastened to the underside of the playfield. Bumpers 16 prevent damage to game components that are attached to the underside of the playfield by preventing contact between the components and the cabinet walls during movement of the playfield.

Figure 2A:
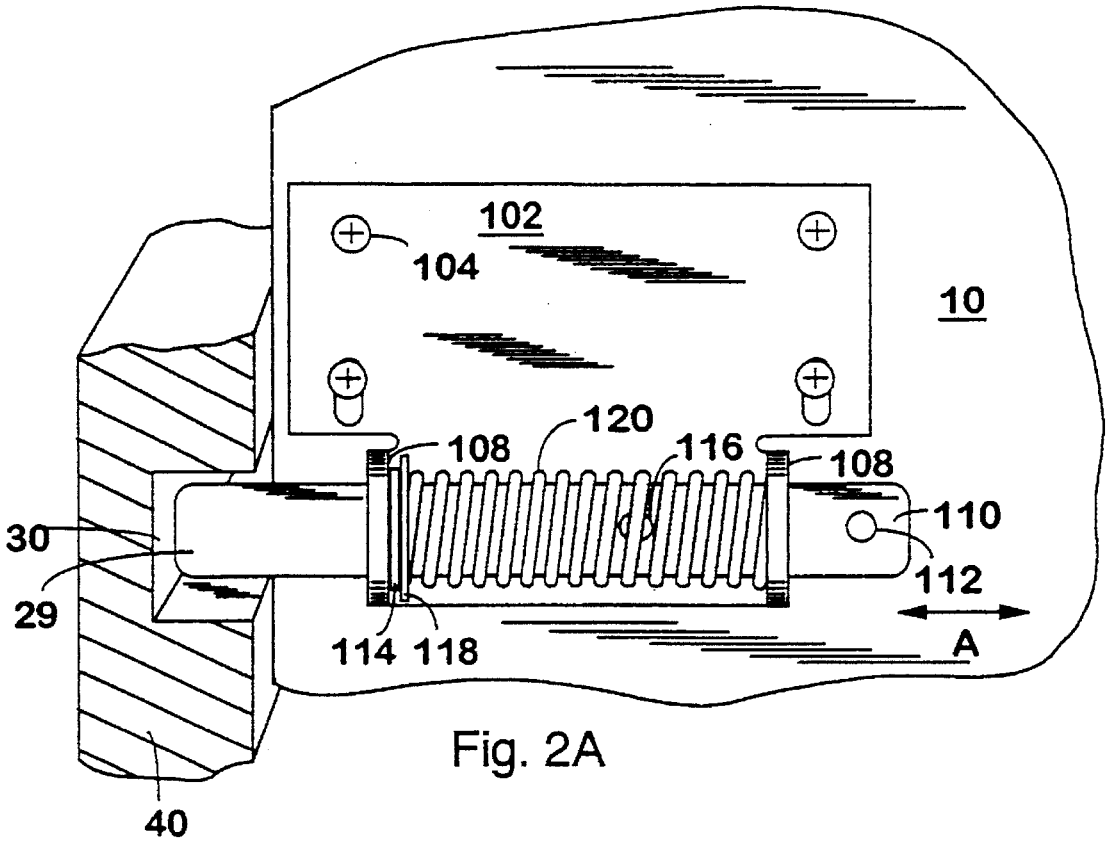
FIGS. 2A and 2B illustrate a pivot pin of a preferred embodiment of the present invention in an extended and retracted position, respectively.
Figure 2B:
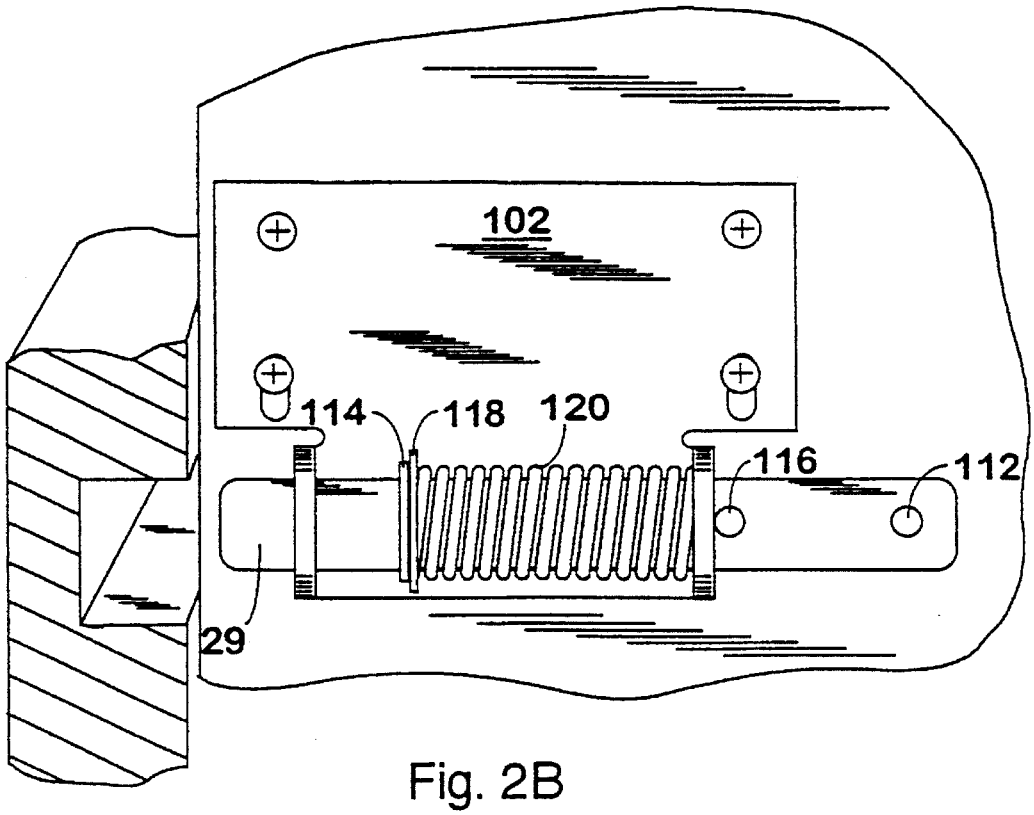
Figure 4:
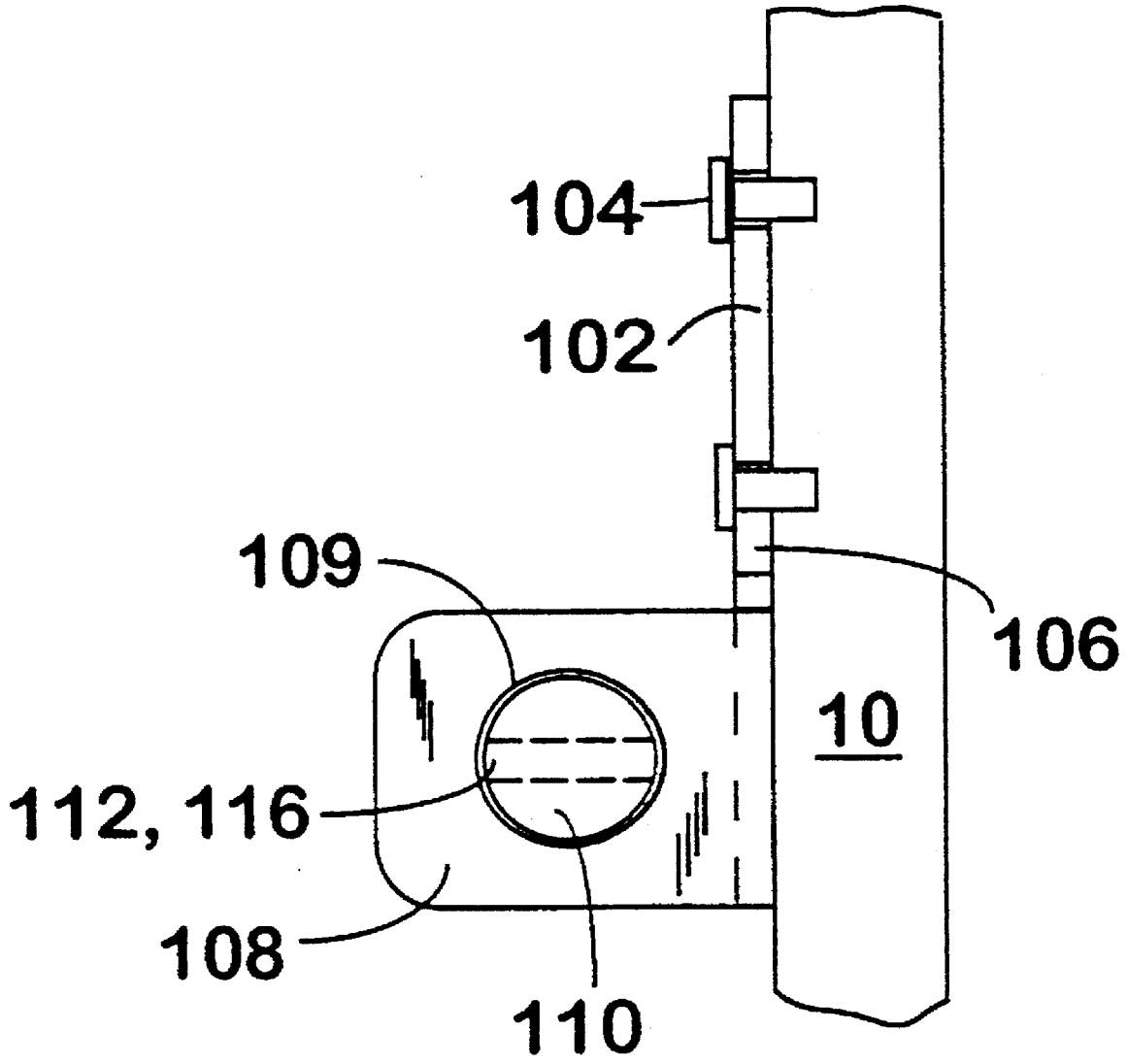
FIG. 4 is a side view of the bracket and pivot pin of a preferred embodiment of the present invention.

Referring to FIGS. 2A and 2B, there is shown a pivot pin assembly in accordance with a preferred embodiment of the present invention. FIG. 2A shows the pivot pin assembly provided on the left side of the playfield in the extended position where its end 29 resides in groove 30. FIG. 2B shows the pin retracted from the groove to allow playfield removal. A second pivot pin assembly (not shown) is also provided on the fight hand side of the underside of the playfield and cooperates with a corresponding groove in the fight hand side of the wall of the game cabinet. Pivot pin 110 is mounted for sliding movement to bracket member 102 having guide members 108 which extend perpendicular to the plane of the playfield. Each guide member 108 is provided with an annular recess 109, as shown in FIG. 4 which slidably receive the pivot pin 110. Bracket 102 is provided with holes or slots 106 through which fasteners 104 are installed to fasten the bracket 102 to the underside of playfield 10.

Compression spring 120, which is mounted between guide members 108, provides biasing force to the pivot pin.

A thrust washer 118 is secured to pivot pin 110 and held against an E-clip 114 by the force of spring 120. An annular slot (not shown) is provided on pivot pin 110 to receive E-clip 114. E-clip 114 also functions to limit travel of the pivot pin 110 within guide members 108 and ensures that pin 110 extends into groove 30 a correct distance without interfering with the surface of groove 30.

The pivot pin is provided with a thru-hole 112 to provide a means for gripping the pivot pin to move it against the force of spring 120 to the retracted position. A tool or cable may be inserted in thru-hole 112 to allow retracting of the pin. Another hole 116 is provided in pivot pin 110 which is accessible when the pin is retracted. Hole 116 allows insertion of a tool to lock the pin in the retracted position.

Figure 3A:
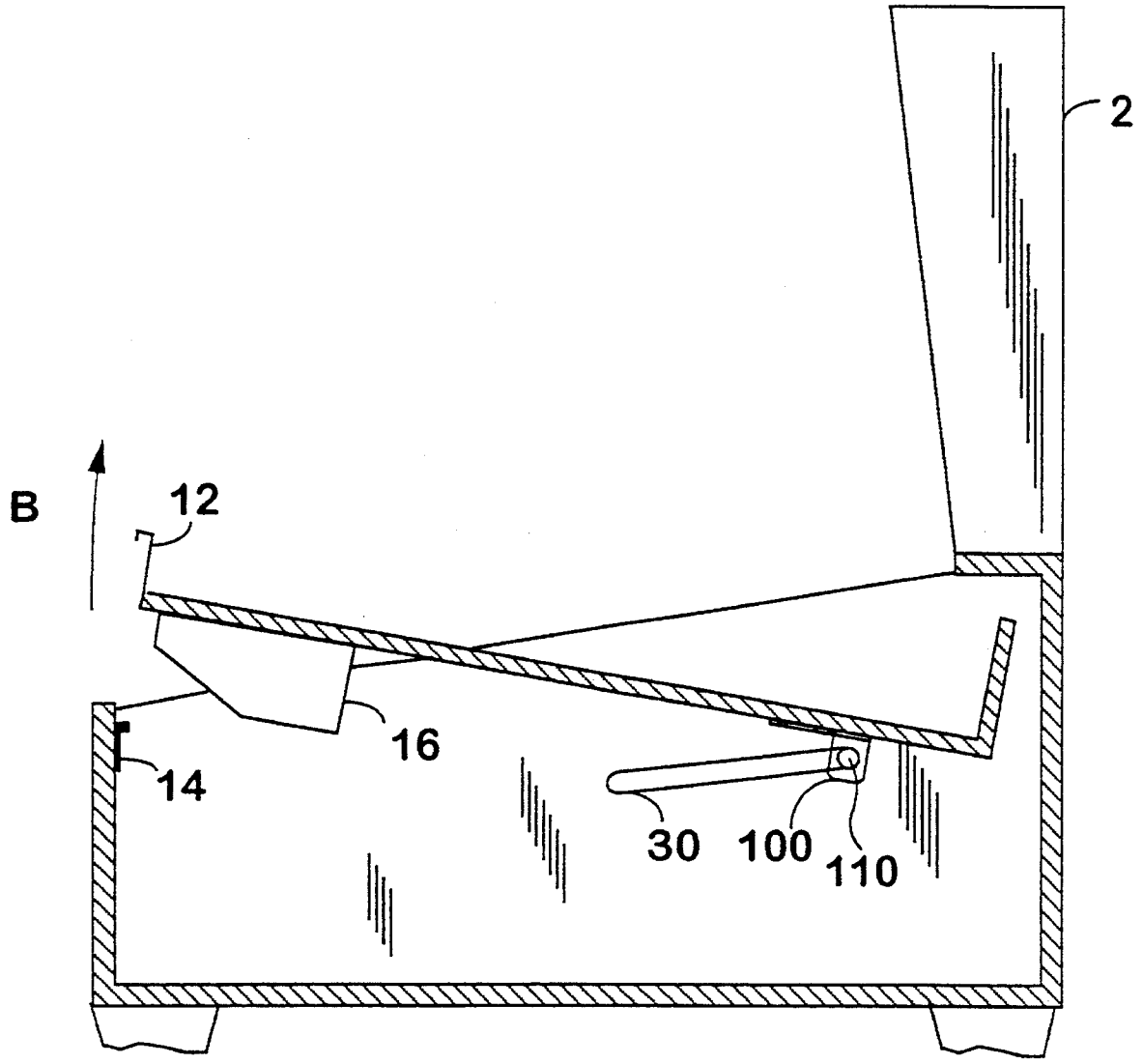
FIGS. 3A–3C illustrate the movement of the playfield within the cabinet as provided by a preferred embodiment of the present invention.
Figure 3B:
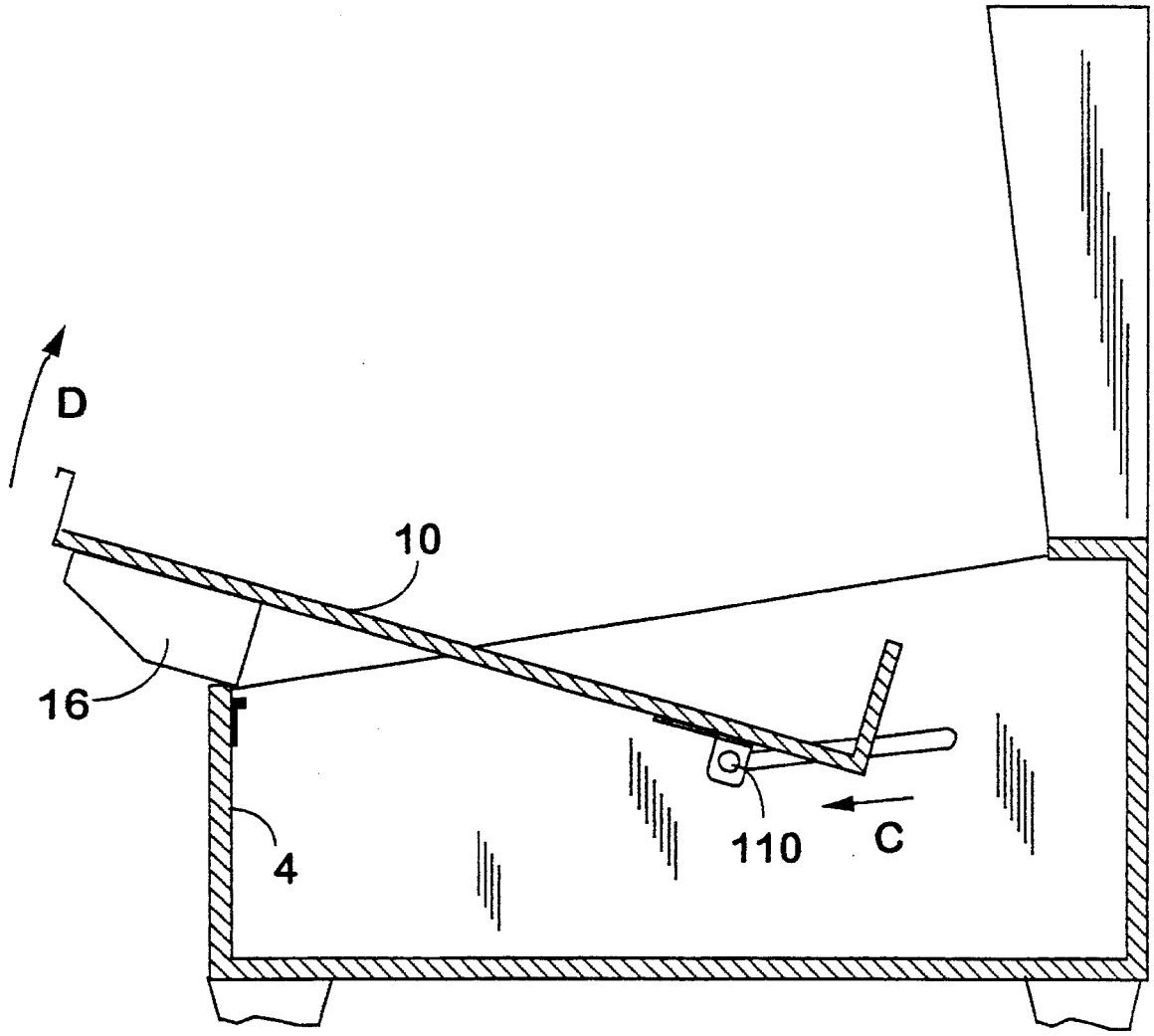

In the extended position as shown in FIG. 2A, the left end of pivot pin 110 extends within groove 30 in the wall of the game cabinet 40. The two pivot pins, one in each groove on the cabinet, allow the playfield to slide and pivot within the cabinet as shown in FIGS. 3A–3B as described below. When removal of the playfield from the game cabinet is desired, the operator, using a tool inserted into hole 112 retracts each pivot pin to the position shown in FIG. 2B and inserts a tool such as a screwdriver into thru-hole 116 thereby locking the pivot pin in the retracted position. Spring 120 is then compressed against thrust washer 118.

Figure 3C:
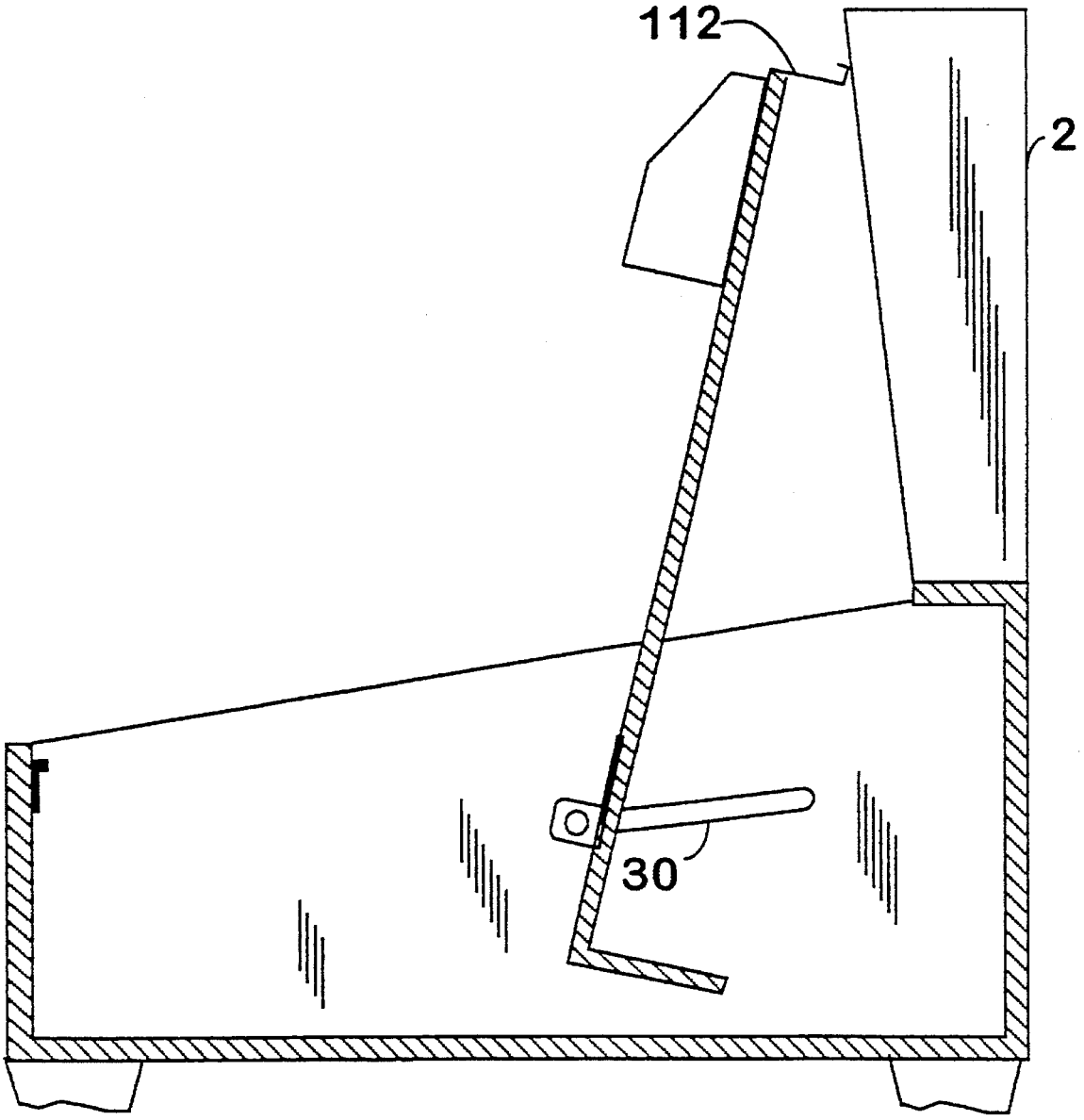

Referring to FIGS. 3 A through 3C, the pivotal movement and sliding movement of the playfield with respect to the cabinet is illustrated. The initial stage of the pivoting operation is shown in FIG. 3A. The front side of playfield 10 is pivoted upwards in the direction of arrow B. Bracket 12 is thereby separated from bracket 14. Once the bumpers 16 clear the game cabinet front 4, the playfield 10 is free to move forward towards the operator or repair person. Groove or slot 30 is inclined with respect to the horizontal so that the weight of the components on the playfield assist the operator in moving the playfield forward. The playfield may thus move to the position shown in FIG. 3B wherein pivot pin has traveled the extent of slot 30 and the forward end of the playfield 10 rests upon the bumper element 16 which, in turn, rests upon the top of the front of the game cabinet panel 4. Pivotal movement of the playfield may then continue in the direction of arrow D until the playfield is in its upright position shown in FIG. 3C. The forward or now upper end of the playfield rests via bracket 112 against the back box 2. Complete access to the underside of the playfield is thus provided. Furthermore, the weight of the components on the playfield create a moment on the playfield about the pin so that the playfield is held in a stable upright position. It is to be understood that the bracket member 102 is preferably fastened to the underside of the playfield near the center of gravity of the playfield so that the amount of force necessary to cause pivoting is minimized.

As will be apparent to those of ordinary skill in the art from the above description, the pivot pin and game cabinet construction of the preferred embodiment of the present invention provides a simplified construction when compared to the prior art and reduces the amount of effort required by the operator in pivoting the playfield to the upright position.

While the pinball game cabinet and pivot pin of the preferred embodiment of the present invention has been described in some detail with reference to the figures, numerous changes and modifications will be apparent to those of ordinary skill in the art without departing from the spirit and scope of the claims which follow.

What Is claimed is:

1. A device pivotally mounting a game playfield in elongated grooves disposed in the side walls of a game cabinet, said device comprising:

a pair of pivot assemblies, each mounted to a respective side of said playfield and each including:

(a) an elongated pivot pin cooperating with a respective one of said game cabinet grooves whereby each pivot pin provides for pivotal and sliding movement of said playfield with respect to said game cabinet; and (b) means for mounting said pivot pin for axial movement between an extended position in which said pin is disposed within said respective one of said grooves and a retracted position in which said pin is removed from said respective one of said grooves, to permit removal of said playfield from said cabinet.

2. The device of claim 1, wherein each pivot assembly further comprises means for biasing said pivot pin towards said extended position.

3. The device of claim 2, wherein each of said means for biasing comprises a coil spring.

4. The device of claim 3, wherein said coil spring is disposed around said pivot pin and cooperates with a thrust washer fastened to said pivot pin to provide biasing force.

5. The device of claim 1, wherein each of said pivot assemblies further comprises means for locking the pivot pin in said retracted position.

6. The device of claim 5, wherein said means for locking comprises a hole through said pivot pin.

7. The device of claim 1, wherein each of said pivot assemblies further comprises means for limiting axial movement of said pivot pin.

8. The device of claim 7, wherein said means for limiting movement comprises a thrust washer fastened to said pivot pin and a flange fastened to said playfield and provided with a hole through which said pivot pin moves axially, said thrust washer abutting said flange when said pivot pin is in said extended position.

9. The device of claim 1, wherein each of said grooves extends in a direction which is inclined to the horizontal such that the weight of said playfield acts to bias said pivot pins in a direction towards a front end of said game cabinet.

10. The device of claim 1, wherein each pivot pin further comprises means for pulling the pivot pin to said retracted position.

11. The device of claim 10, wherein said means for pulling comprises a hole through said pivot pin.

12. A device pivotally mounting a game playfield to a game cabinet comprising in combination:

a pinball game cabinet having elongate grooves disposed therein;

a pinball playfield disposed within said cabinet;

means for mounting said playfield within said cabinet for pivotal and sliding movement, said means for mounting comprising at least two pin members disposed on said playfield and cooperating with a respective one of said grooves.

13. A device pivotally mounting a game playfield to the sidewalls of a game cabinet comprising:

a) an elongate pivot pin having an axis;

b) bracket means for mounting said pivot pin to a game playfield;

c) means for supporting the pivot pin for axial movement with respect to said bracket means between an extended position in contact with said sidewalls and a retracted position; and d) means for biasing said pivot pin towards said extended position;

whereby said pivot pin supports said playfield with said cabinet for pivotal and sliding movement with respect to said cabinet.

14. The pivot device of claim 13, wherein said means for providing axial movement comprises two guide members disposed on said bracket, each having an annular recess therein for slideably receiving said pivot pin.

15. The pivot device of claim 14, further comprising means for biasing said pin in said extended position.

16. The pivot device of claim 15, wherein said means for biasing comprises:

a) a thrust washer fastened to said pivot pin;

b) a spring member disposed between said pivot pin and one of said guide members.

17. The pivot device of claim 16, wherein said thrust washer is located on said pivot pin such that said thrust washer engages the other of said guide members when said pivot pin is at said extended position.

18. The pivot device of claim 17, wherein said pivot pin is provided with means for locking said pivot pin in said retracted position.

* * * * *